US005079939A

United States Patent [19]

Shook

[11] Patent Number: 5,079,939

[45] Date of Patent: Jan. 14, 1992

[54] ROLLING MILL STRIP WIPERS

[75] Inventor: James J. Shook, Leechburg, Pa.

[73] Assignee: Allegheny Ludlum Corporation, Pittsburgh, Pa.

[21] Appl. No.: 675,976

[22] Filed: Mar. 25, 1991

[51] Int. Cl.[5] ..... B21B 45/04

[52] U.S. Cl. ..... 72/39; 72/43

[58] Field of Search ..... 72/39, 41, 43, 40, 236; 118/264, 266, 269

[56] References Cited

U.S. PATENT DOCUMENTS

| | | | |
|---|---|---|---|
| 3,018,756 | 1/1962 | Kilham | 118/269 |
| 3,416,490 | 12/1968 | Munson | 118/269 |
| 4,589,950 | 5/1986 | Sekavec, Jr. | 118/266 |

FOREIGN PATENT DOCUMENTS

| | | | |
|---|---|---|---|
| 1947890 | 9/1968 | Fed. Rep. of Germany | 118/266 |
| 2004706 | 2/1970 | Fed. Rep. of Germany | 118/266 |
| 2492282 | 4/1982 | France | 72/43 |
| 2122024 | 5/1990 | Japan | 72/43 |

*Primary Examiner*—Lowell A. Larson
*Assistant Examiner*—Michael J. McKeon
*Attorney, Agent, or Firm*—Patrick J. Viccaro

[57] ABSTRACT

A rolling mill strip wiper assembly is provided which includes an elongated strip wiper positionable transversely to the direction of travel of the moving strip, having a substantially rigid wiper body which supports on its exterior one or more layers of permeable media, one or more inlet ports in the wiper body for receiving a liquid which is channeled to outlets for permitting the liquid to impregnate the permeable media on at least one such strip wiper positionable on at least one side of the moving strip, thereby effectively removing and preventing accumulation of virtually all contaminate matter carried by the strip.

7 Claims, 4 Drawing Sheets

ROLLING MILL STRIP WIPERS

BACKGROUND OF THE INVENTION

1. Field of the Invention

The present invention relates generally to methods and apparatus for removing contaminants from a moving workpiece and, more particularly, to methods and apparatus for wiping contaminants from a rolled metal strip while the strip is being cold rolled.

2. Description of the Prior Art

In cold rolling of metal strip, lubricant-coated strip passes through one or more mill stands in order to temper or reduce the strip to a desired thickness. When rolling, however, there normally occurs a "plate-out" effect, i.e., in the roll bite, water is squeezed out of the oil emulsion, whereby contaminants such as minute dirt particles tend to adhere to the residual oil and accumulate on the strip. Consequently, passage of the accumulated contaminants through the roll bite frequently cause "rolled-in" defects to be formed on the strip surface. The lubricant can also become polymerized when subjected to the elevated temperatures and high pressures of rolling the strip to finished gauge.

A number of ways and means have been introduced for lubricating while minimizing excess lubricant that is carried by a strip during cold rolling and/or final coiling thereof.

The earliest attempts at reducing the quantity of lubricant carried by the strip involved using bar wipers. For example, simply placing a rubber hose wiper across the width of the strip acts as a squeegee or striking the excess lubricant material from the moving strip. Along with failing to completely remove the lubricant carried by the strip, rubber hoses and other bar wipers required frequent changing because of their inherent low durability, and the strip commonly became etched or marked by stray waste chips of metal or other particles which may become embedded in the hose.

To overcome many of the problems related to bar or rubber hose wipers, metallic roller wiping systems have been developed which generally include three metallic wiper rollers (one positioned above the strip and two below, or vice versa) extending transversely to the moving strip.

Three-roll wipers embodying metallic wiper rollers have been used for over 10 years on some United States and many European Sendzimir mills (Z-mills) for rolling stainless steels. Their advantages relative to bar wipers (i.e., rubber hose type) are that both lost time due to frequent changing of wiper hoses and strip marking caused by chips which become embedded in the hoses are eliminated.

Improved three-roll metallic wiper assemblies including wiper rollers that are backed-up, including smaller diameter wiper rolls than those of conventional three-roll design are commercially available under the tradename, Pollastrelli. The smaller diameter rollers wipe more effectively and can be changed very quickly by hand. Also a spring-loaded support roller arrangement present in advanced three-roller wiper designs, in conjunction with the more flexible smaller diameter wiper rollers, ensures much more uniform wiping pressure, even if the strip profile is not uniform (as occurs frequently), thereby ensuring uniform wiping at all points across the strip width. In addition, because the wiper assemblies are lighter, it is usually possible to provide a floating arrangement whereby the wipers will float up and down to follow the strip pass line.

Non-metallic roller wiper systems and lubricant vacuum systems are also known, each of which possess particular advantages and disadvantages.

Notwithstanding their individual and collective advantages, however, the known systems for wiping lubricant carried by a moving metal strip during cold rolling thereof fail to completely remove all oil lubricant from the strip. Therefore, they likewise fail to remove and prevent accumulation of lubricant contaminate matter which could become rolled into the strip.

It is therefore an object of the present invention to provide a rolling mill strip wiper assembly for effectively removing and preventing virtually all lubricant deposits and accumulations of contaminate matter borne by the strip.

Another object is to provide an uncomplicated wiper assembly for applying a liquid to a moving metal strip which assembly can be easily changed.

Still other objects and advantages of the present invention will become apparent in light of the attached drawings and written description of the invention presented hereinbelow.

SUMMARY OF THE INVENTION

The present apparatus includes a strip wiper assembly positionable transversely to the direction of motion of the moving strip and having a substantially rigid wiper body which supports on its exterior one or more layers of permeable media. One or more inlet ports are provided in the wiper body for receiving liquid. The inlet port(s), in turn, lead to one or more channels formed in the wiper body having outlets for permitting the liquid to impregnate the permeable media. A portion of the expendable layer of one such strip wiper is positionable to contact one side of the moving strip to uniformly apply the liquid to the strip. To overcome the problems associated with known systems for reducing the quantity of oil lubricant carried by moving steel strip during cold rolling thereof, one embodiment of the present invention is a rolling mill strip wiper system which simultaneously dissolves oil lubricant and gunk deposits carried by the strip and wipes the dissolved deposits from the strip thereby preventing buildup of contaminate matter which might become rolled into the strip and/or captured between the convolution of the rolled strip. The assembly thereby effectively removes and prevents accumulation of virtually all lubricant deposits and contaminate matter carried by the strip.

DESCRIPTION OF THE PREFERRED EMBODIMENTS

Figure 1:
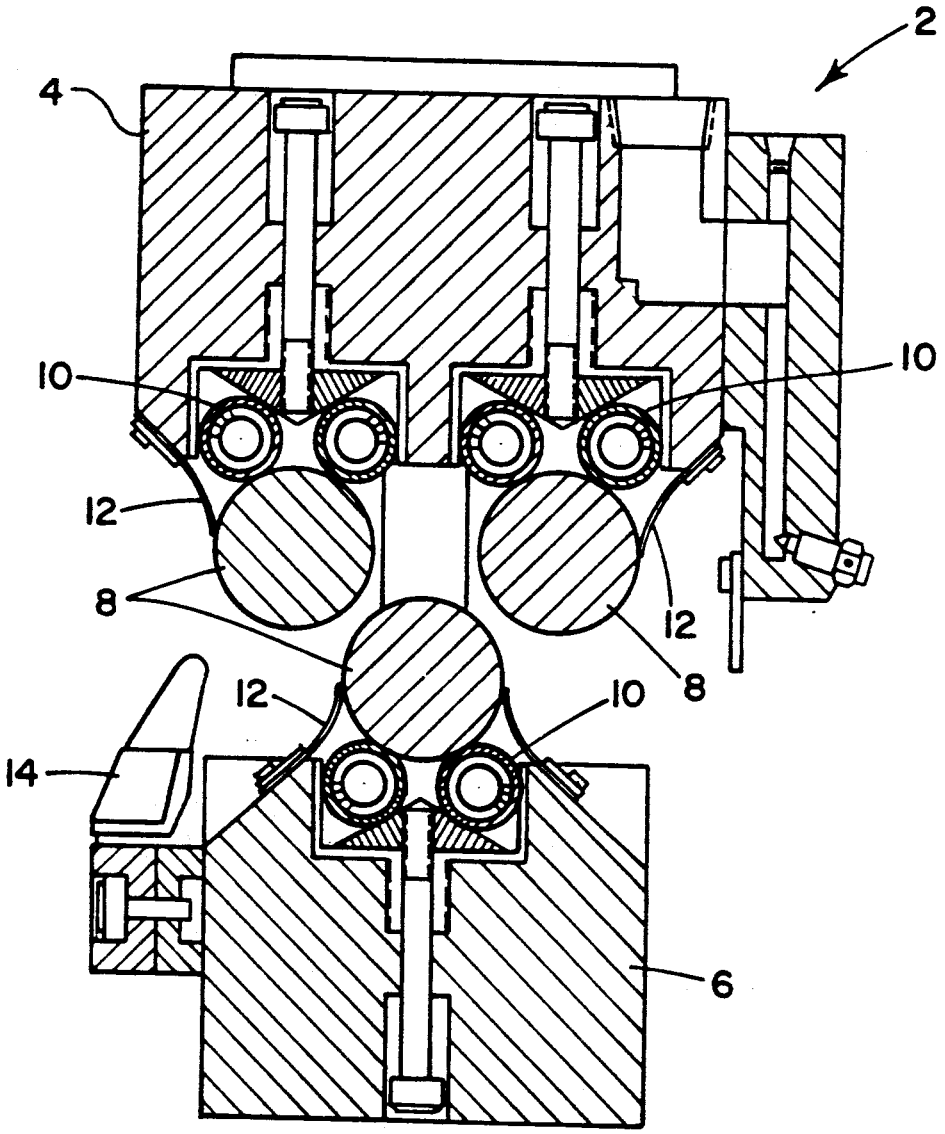
FIG. 1 (PRIOR ART)
FIG. 1 is an example of a typical prior art three-roll wiper system having metallic wiper rollers.

FIG. 1 shows a typical prior-art three-roll strip wiper assembly 2 having upper and lower roller support housings 4 and 6 which respectively carry two and one metallic wiper rollers 8. The rollers 8 extend transversely to the direction of travel of the strip. Support housings 4 and 6 are translatable toward and away from one another by the provision of suitable extensible and retractable means, e.g., hydraulic cylinders (not shown).

Each of the wiper rollers 8 is backed up by a plurality of back-up rollers 10 arranged in an end-to-end relation and rotatably supported by the support housings 4 and 6 at spaced apart locations along the lengths of the wiper roller(s) 8. Each wiper roller is contacted by at least one flexible flap member 12 attached to one or the other of the support housings to prevent accumulations of lubricants, contaminants, and the like, in the regions of back-up bearings 10. A pressurized air jet or "blow-off" 14 is provided adjacent to each end of lower support housing 6 to prevent excessive lubricant and contaminant accumulations at the ends of the wiper rollers.

Figure 2:
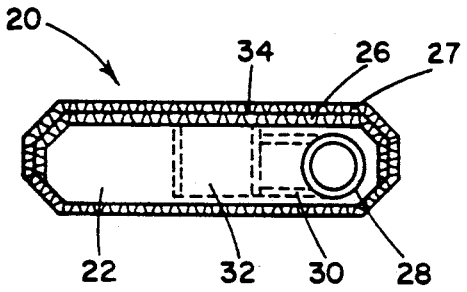
FIG. 2 is an end view of a first embodiment of a strip wiper for use in the strip wiper assembly of the present invention.
Figure 3:
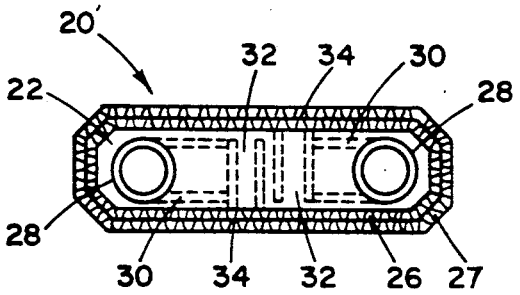
FIG. 3 is a view similar to FIG. 2 of a second embodiment of a strip wiper for use in the strip wiper assembly of the present invention.
Figure 4:
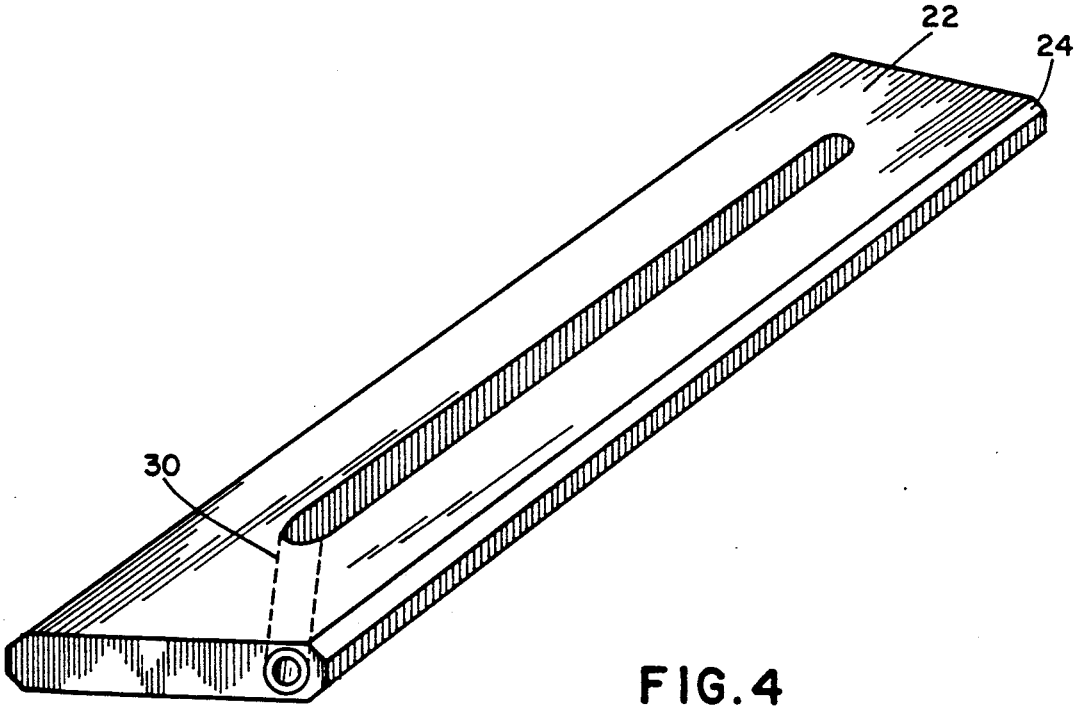
FIG. 4 is a perspective view of a preferred wiper body member for use in the strip wiper assembly of the present invention.

In FIGS. 2, 3 and 4, wherein like references indicate similar elements, there are depicted the primary components of two preferred embodiments of the strip wipers of the present invention. In FIG. 2, a first embodiment of the strip wiper is designated by reference numeral 20 whereas in FIG. 3 a second embodiment of the strip wiper is indicated by the numeral 20'. As used herein the wiper is used to apply a liquid to the strip for any purpose, including cleaning, lubricating or coating the strip.

Each strip wiper 20 and 20' is comprised of an elongated wiper body member 22 forming a core for the strip wiper. Wiper body member 22 is formed of any suitable substantially rigid material such as, for example, wood or metal or plastic. A suitable plastic is Tiver brand soft recycled plastic sold in dimensional forms, like wood lumber. An enlarged perspective view of the wiper body member of the strip wiper 20 of FIG. 2 is represented by FIG. 4. The corners of wiper body member 22 are preferably rounded, beveled or the like, as at 24, to enable a primary or inner layer 26 of fluid-permeable media, i.e., fabric, sponge material felt, or the like, to be tightly fitted and attached to one side (FIG. 2) or both sides (FIG. 3) of the wiper body member. A suitable fluid-permeable material used is Scotch Brite brand nonabrasive man-made spun fiber material by 3M Corporation. As will be appreciated, depending on the composition of wiper body member 22, primary layer 26 may be suitably attached thereto such as by adhesives, heat bending, or mechanical fasteners, preferably by stapling into plastic wiper body member 22.

Surrounding the wiper body member 22 and primary layer 26 is at least one expendable and removable secondary or exterior sheathing layer 27 also formed of fluid-permeable media, the composition of which may be similar to that of layer 26. However, since it is the exposed exterior layer 27 which contacts the strip being wiped, the material forming layer 27 must be highly durable in order that service and replacement of the wiper member 20 or 20' is minimized. In addition, the texture of the exterior layer must be such that a solvent solution, to be described hereinbelow, is uniformly applied to the strip and accumulations of lubricant, gunk, particulate matter and the like are completely dissolved and wiped from the strip.

According to the first embodiment 20 of the strip wiper of the present invention, body member 22, as seen in FIGS. 2 and 4, includes a single inlet means 28 leading via channel 30 to an outlet means 32 having an opening 34 facing toward the side of the wiper body member to which primary layer 26 is attached. In the embodiment illustrated by FIG. 3, however, two separate inlet means 28 are provided which lead to two separate outlet means 32 having separate outlet openings 34 facing toward opposite sides of the wiper body member 22. Such a two-sided wiper would permit the wiper to be easily slipped over to the opposite side after the first side has wore out and needs replaced. This would permit longer use of a given strip wiper 20' before removal from service for replacement of sheathing layer 27.

Figure 5:
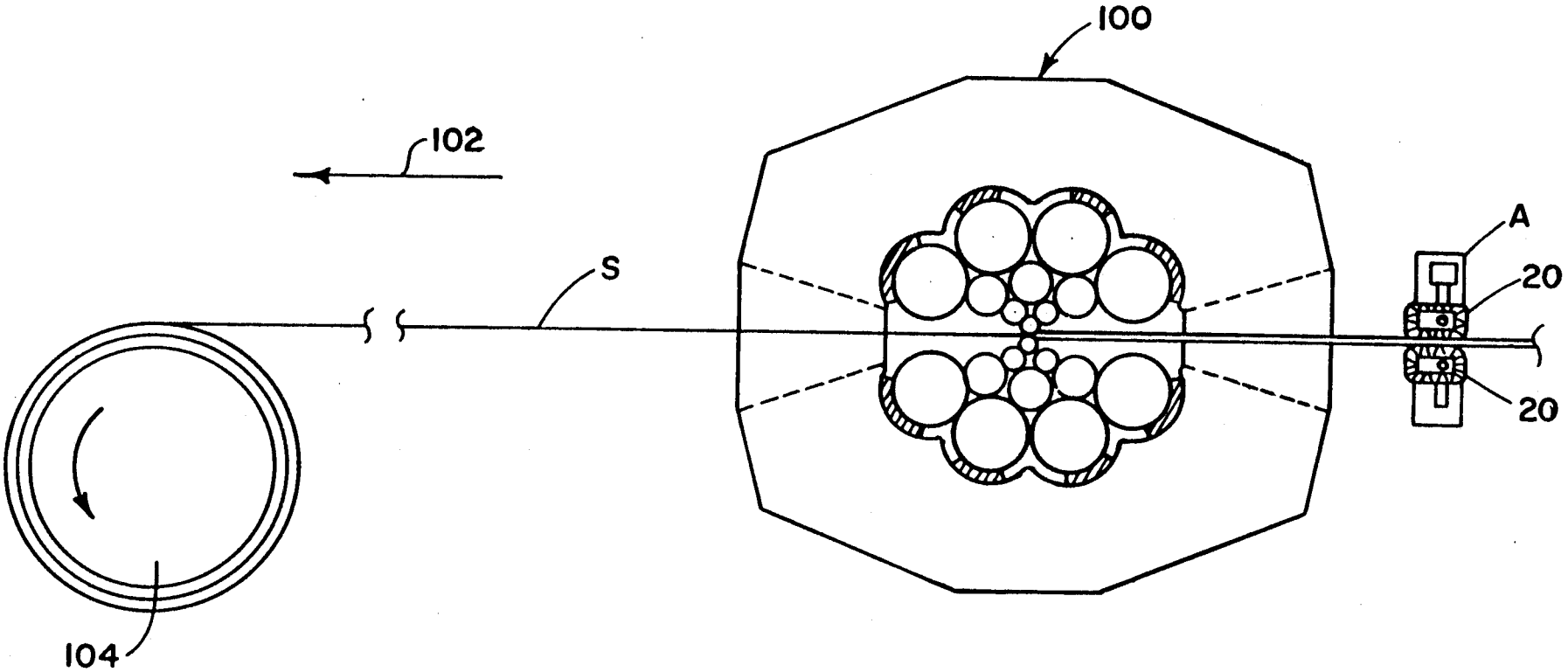
FIG. 5 illustrates the strip wiper assembly of the present invention in use adjacent a first type of rolling mill stand.
Figure 6:
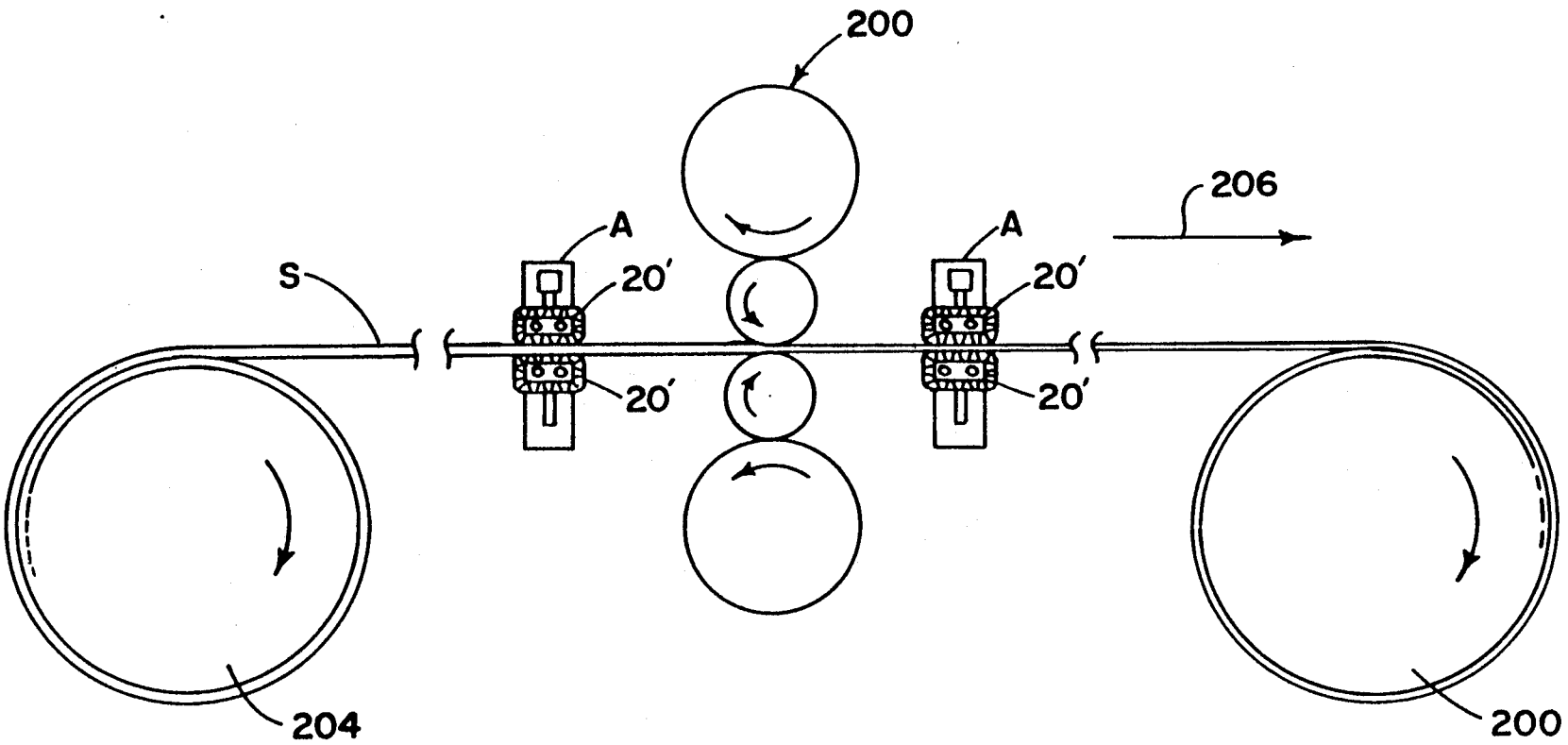
FIG. 6 illustrates the strip wiper system of the present invention for use in a 4-high rolling mill stand.

In operation, as is perhaps best appreciated with reference to FIGS. 5 and 6, at least one pair of strip wipers 20 (or 20') form part of a strip wiper assembly A including means for positioning the wipers on opposite sides of the moving strip S so as to contact the strip. If a pair of strip wipers 20 are being used, as in FIG. 5, their inlet means 28 are connected to a supply of solvent solution and each of their respective outlet openings 34 face toward one another on opposite sides of the strip. If a pair of strip wipers 20' are being used, as in FIG. 6, only one of each of their outlet openings will be "active", i.e., only one of their inlet means 28 will be connected to a supply of solvent solution, and it is those "active" outlet openings which face toward one another on opposite sides of the strip S during operation of the strip wiper assembly.

Prior to or after commencement of cold rolling of the strip S, the strip wipers 20 (or 20') are brought into contact with the strip and ar caused to become continuously supplied with a solvent solution through inlet means 28. The solvent solution must be capable of dissolving oil lubricant films and gunk deposits borne by the strip without leaving a long-lasting film of its own on the strip. Because of its relatively high volatility and low cost, a preferred ingredient for the solvent solution is kerosene. However, the solvent solution may comprise, inter alia, any suitable volatile light oil solvent, a degreaser if additional cleansing action is required or a combination of cleaning solvents. The solvent solution then saturates inner layer 26 and the area of the outer sheathing layer 27 in contact therewith. When cold reduction begins, oilbased lubricant and accumulated gunk deposits on opposite sides of the moving strip become dissolved and wiped from the strip by movement of the strip past the strip wipers. Along with its cleansing properties the solvent solution provides some degree of cooling and lubrication for the strip while it undergoes cold reduction. However, the composition of the solvent solution must be such that it has a low affinity for particulate accumulation on the strip.

If, for example, more than one sheathing layer 27 is provided on the strip wiper 20, and the outermost layer becomes excessively worn, soiled or chip laden, the exposed layer can be quickly and easily removed and discarded thereby exposing a fresh sheathing layer 27. If, however, one side of the outer sheathing layer 27 of strip wiper 20' (FIG. 3) should become unusable, the strip wiper 20' is simply inverted to expose a fresh side of the sheathing layer and the supply of solvent solution is accordingly connected to the inlet means 28 in communication with the fresh side.

FIG. 5 shows an application of the strip wiper assembly A of the present invention for use with a Sendzimir cold-rolling mill 100 wherein the strip travel direction is indicated by the arrow 102. As is known, Sendzimir cold-rolling mills feature several roll arrangements, a typical one of which is the 1-2-3-4 arrangement illustrated in FIG. 5. In this arrangement, each work roll is supported throughout its entire length by two first-intermediate rolls that are, in turn, supported by three second-intermediate rolls (of which the outer ones are driven) which transfer the roll-separating forces to a rigid, one-piece cast-steel housing through four backing assemblies. The work rolls are driven by the four driven rolls through friction contact with the first intermediate rolls.

Prior to entering Z-mill 100, the strip S passes through a strip wiper assembly A constructed according to the present invention which, in this example, comprises a pair of opposed strip wipers 20 as described hereinabove. It is also possible that strip wiper assembly A may be formed of a pair of strip wipers 20' or a mixed pair of wipers, one being a wiper 20 the other being a wiper 20'. Once treated and cleansed by the strip wiper assembly the strip becomes reduced by the Z-mill 100, and additional mills, if necessary, whereupon it may be coiled into a finished coil 104. The strip wiper assembly A thus completely cleans the strip S prior to its reduction such that defects formed by rolled-in accumulations of contaminate matter as well polymerization of lubricant oil deposits in the finished coil are effectively prevented. Although not shown, a strip wiper assembly A may also be located between the Z-mill and coiler.

FIG. 6 illustrates a second application of the strip wiper assembly A of the instant invention for use with a 4-high reversing mill 200. A typical four-high reversing mill consists of a single stand with reels, herein designed by reference numerals 202 and 204, located on each side of the mill. The mill itself is essentially the same in design and arrangement as the individual stands of a tandem mill, i.e., large backing rolls are employed to support smaller working rolls wherein either the backing or working rolls may be driven.

In the reversing mill 200, the steel must be passed back and forth until the required reduction is obtained. Passage of the strip in a first of the two opposite directions is indicated by arrow 206. On the entry side of the mill, means (not illustrated) are provided for uncoiling and feeding the coil through the mill to the tension reel on the delivery side. After the first pass, the tail end of the coil coming from the uncoiler is gripped by the second tension reel on the entry side of the mill. In each pass, the reel serving as the payoff unit is operated as a generator, providing back-tension to minimize rolling friction and feeding of current into the drive-reel motor. On the last pass, the tail end of the coil is released from the unwinding tension reel, completely wound on the winding reel and stripped in a manner similar to the action on the delivery reel of the tandem mill.

According to this particular example, strip wiper assemblies A are located on opposite sides of reversing mill 200 and each assembly comprises a pair of strip wipers 20', although, as stated hereinabove with regard to FIG. 5, the assemblies A may be comprised of any combination of wipers 20 and 20'. By locating the strip wiper assemblies on opposite sides of reversing mill 200, the strip is continuously cleaned throughout the reverse milling reduction process.

Although not exhaustively illustrated to exhibit all of its possible manifestations and applications, it is further contemplated that within the scope of the present invention it is possible to provide one or more strip wiper assemblies A as disclosed herein in virtually any cold mill steel reduction facility.

Although the invention has been described as a wiper assembly, it is also contemplated that assemblies 20 or 20' may be applicators, primarily for applying controlled amounts of liquids, such as oil, and corrosion inhibitors, such as rust preventatives, and only secondarily for wiping accumulations from the strip.

While the present invention has been described in connection with the preferred embodiments of the various figures, it is to be understood that other similar embodiments may be used or modifications and additions may be made to the described embodiments for performing the same function of the present invention without deviating therefrom. Therefore, the present invention should not be limited to any single embodiment, but rather construed in breadth and scope in accordance with the recitation of the appended claims.

I claim:

1. Apparatus for applying a liquid to a moving metal strip surface, said apparatus comprising:

an elongated body member extending substantially transverse to the direction of travel of said strip, said body member including first and second substantially oppositely directed faces, inlet means for receiving a liquid, and outlet means for discharging the liquid, said outlet means including first outlet opening means for discharging the liquid only from said first face substantially across the strip;

a first layer of fluid-permeable media attached to at least one face of said body member and covering said outlet means; and at least one expendable layer of fluid permeable media covering said first layer, said first layer and said expendable layer being formed of a material capable of saturation by the liquid, said expendable layer being adapted to contact one surface of said strip in order to uniformly apply the liquid to the strip.

2. The apparatus of claim 1 wherein said inlet means includes first inlet port means for communicating said liquid to said first outlet opening means.

3. The apparatus of claim 2 wherein said outlet means further includes second outlet opening means for discharging said liquid only from said second face.

4. The apparatus of claim 3 wherein said inlet means includes second inlet port means independent of said first inlet port means for communicating said solvent solution to said second outlet opening means.

5. The apparatus of claim 1 wherein the liquid is selected from the group consisting of solvents, degreasers, cleansers, corrosion inhibitors.

6. The apparatus of claim 5 wherein the liquid comprises a solvent for dissolving oil-containing deposits borne by said strip.

7. An assembly for removing contaminants from a moving metal strip undergoing a cold rolling process, said assembly including first and second apparatus positionable at opposite sides of said strip, each of said first and second apparatus comprising:

an elongated body member extending substantially transverse to the direction of travel of said strip, said body member including first and second substantially oppositely directed faces, inlet means for receiving a solvent solution, and outlet means for discharging said solvent solution, said outlet means including first outlet opening means for discharging the liquid only from said first face substantially across the strip;

a first layer of fluid-permeable media attached to said body member and covering said outlet means; and at least one expendable layer of fluid permeable media covering said first layer, said first layer and said expendable layer being formed of a material capable of saturation by the solvent solution, said expendable layer being adapted to contact one surface of said strip in order to uniformly apply the solvent solution and to wipe contaminants from said strip.

* * * * *